United States Patent [19]

Claiborne

[11] 4,380,453

[45] Apr. 19, 1983

[54] EXTRANEOUS DYE OR COLORANT SCAVENGING SYSTEM IN LAUNDRY

[75] Inventor: J. Lyle Claiborne, Hixson, Tenn.

[73] Assignee: Dixie Yarns, Inc., Chattanooga, Tenn.

[21] Appl. No.: 206,277

[22] Filed: Nov. 12, 1980

Related U.S. Application Data

[62] Division of Ser. No. 119,154, Feb. 6, 1980, abandoned.

[51] Int. Cl.[3] ..... B08B 3/00

[52] U.S. Cl. ..... 8/606; 8/137; 8/576

[58] Field of Search ..... 8/576, 606, 137

[56] References Cited

U.S. PATENT DOCUMENTS

| | | | |
|---|---|---|---|
| 2,131,120 | 9/1937 | Schlack | 525/504 |
| 3,510,246 | 5/1970 | Keen et al. | 8/116.2 |
| 3,694,364 | 9/1972 | Edwards | 252/90 |
| 3,936,537 | 2/1976 | Baskerville, Jr. et al. | 252/8.8 |
| 4,065,257 | 12/1977 | Coe | 8/602 |
| 4,095,946 | 6/1978 | Jones et al. | 8/137 |
| 4,246,670 | 1/1981 | Perrin | 8/566 |

FOREIGN PATENT DOCUMENTS

| | | |
|---|---|---|
| 737759 | 2/1970 | Belgium . |
| 861515 | 6/1978 | Belgium . |
| 2608577 | 9/1976 | Fed. Rep. of Germany . |
| 2061533 | 6/1971 | France . |
| 1236882 | 6/1971 | United Kingdom . |

OTHER PUBLICATIONS

Rupin (Textile Chemist and Colorist, 1976, 8, (No. 9), pp. 54/139–58/143.

*Primary Examiner*—A. Lionel Clingman
*Attorney, Agent, or Firm*—Parkhurst & Oliff

[57] ABSTRACT

A system for controlling extraneous free flowing dyes or colorants in a liquid bath by using a dye scavenger member having a textile substrate or the like impregnated with a dye scavenging material such as N-trisubstituted ammonium 2 hydroxy 3 halopropryl compounds or salts of epoxy propyl ammonium compounds such as glycidyltrimethylammonium chloride. Such members, and the methods of making and using same are included.

13 Claims, No Drawings

EXTRANEOUS DYE OR COLORANT SCAVENGING SYSTEM IN LAUNDRY

This is a division of application Ser. No. 119,154 filed Feb. 6, 1980, now abandoned.

BACKGROUND

The present invention relates to a system for removing undesirable random free flowing dyes from baths containing other materials to which association of such random dyes is undesirable. More particularly, this invention relates to a dye scavenger cloth for use in a conventional washing machine for laundering clothes to eliminate random dyes from the washing and rinsing waters, thus eliminating undesirable discoloration of some clothes by fading of dyes from others.

For as long as non-colorfast fabrics or other substrates have been laundered with, or otherwise combined in baths with, fabrics or substrates having different colors, the problem which is commonly known as "fading" wherein some amount of the dye from one fabric or substrate becomes disassociated with its original fabric or substrate, and undesirably discolors another fabric or substrate, has been a problem. This is particularly so in the home washing machine, and in the laundry industry generally. Typically, the attempted solutions to this long-standing problem have been attempts to make dyes more adherent to the original fabric or substrate to which they were intentionally applied. Stated otherwise, there have been many attempts to improve the affinity of a dye for its original fabric substrate, and thus increase the fastness of that dye to its original fabric substrate, regardless of the subsequent conditions to which that dyed fabric or substrate may thereafter be subjected.

For example, Rupin, Michel, "Dyeing with Direct and Fiber Reactive Dyes," Textile Chemists and Colorist, Vol. 8, No. 9, September, 1976, pages 139/54–143/58, discloses the amination of cellulose as a method to facilitate dyeing of cellulose by direct and fiber reactive dyes. Rupin reports that quaternary ammonium compounds such as glycidyltrimethylammonium chloride (sold under the trademark Glytac by Societe Protex, Levellois, France) can be applied to fabric either prior to dyeing or simultaneously with reaction, for example by adding Glytac to the dye bath. This results in improved dyeing efficiency and improved direct dye fastness for cellulose fabrics, and similar applications to polyester/cotton blends are also suggested. The quaternary ammonium compounds per se, are known, as indicated in Rupin, supra, and the references cited therein, such as U.S. Pat. No. 2,131,120, British Pat. No. 971,358; French Pat. Nos. 1,490,066; 1,589,218; 2,041,703; 2,061,533; and 2,096,702.

BRIEF SUMMARY OF THE INVENTION

It is, therefore, an object of this invention to provide a novel dye scavenging system.

It is another object of this invention to provide a novel dye scavenging member.

It is another object of this invention to provide a simple and economical system for scavenging undesirable dyes or colorants from laundry wash or rinse waters.

The foregoing objects and others are accomplished in accordance with the present invention wherein a dye scavenger member comprising a substrate, for example a textile substrate, impregnated with a quaternary ammonium compound such as glycidyltrimethylammonium chloride is used in a bath containing dyed materials, wherein the dye scavenger member serves to adsorb any undesirable dyes which become disassociated from the originally dyed or colored materials, thereby preventing undesirable discoloration of other materials in the bath by the disassociated random dyes.

DETAILED DESCRIPTION

The problem commonly known as "fading" in home and commercial laundries has long plagued housewives and businessmen. It is well known that a typical mix of materials being laundered will have somewhat different colors, even if sorted into the so-called "white" and "colored" batches. Although fading of dyes is more prevalent from new, unlaundered, or heretofore infrequently laundered goods, even articles with considerable fastness to washing, or having a long history of numerous previous launderings, may continue to bleed small amounts of dyestuff or colorant into the bath or wash water. The well known, but aggravating and undesirable result of such fading is that at least part of the extraneous, free flowing colorant or dyestuff which has bled from its original material substrate may then be absorbed, adsorbed, reacted with, or otherwise physically deposited on or associated with other materials in the same bath or wash water, thus discoloring this latter item.

While prior attempts to solve this problem have primarily been directed toward making the dyes or colorants have greater affinity for their original material substrate, the present invention is directed to a different aspect of the problem, namely effectively eliminating dyestuffs or colorants which have bled from or faded from the original material upon which they entered the bath or wash water environment. More specifically, the present invention is directed to a dye scavenging member or cloth, and the methods by which such a dye scavenging cloth is used.

The dye scavenging member or cloth of the present invention comprises two basic elements; first, a substrate, and second, a dye scavenging substance which is applied to or impregnated in the substrate.

The substrate of the dye scavenging cloth of the present invention may take any desirable form, and may comprise any desirable material. However, that substrate will typically be a textile material, preferably cellulosic textile material. That textile material may take virtually any form, such as a woven, non-woven, or knitted fabric, a braided rope or ball, or any other desirable configuration. Even paper-like substrates may be used. The purpose of the substrate is to provide a carrier for a dye scavenging material, and to provide a sufficient area over which that dye scavenging material is accessible to the liquid in the bath or wash water in which the dye scavenging member or cloth is to be used. One particularly suitable substrate is a towel-like piece of terry-loop pile cotton fabric. Another particularly preferred substrate is a non-woven fabric "Novonette" available from the Kendall Co., Walpole, Massachusetts. It will be appreciated that any substrate which may be successfully treated with a dye scavenger material, has sufficient wet strength, and sufficient resistance to abrasion with other materials in a bath such as laundry wash or rinse waters, may be satisfactorily used as the substrate for the dye scavenger member of the present invention.

The dye scavenging material which is applied to, adsorbed by, or impregnated into the substrate should be a material which has high affinity for dyes or colorants. Quaternary ammonium compounds, and quaternary ammonium epoxy compounds may be used for this purpose. In particular, the dye scavenging material may comprise a compound of the N-trisubstituted ammonium 2 hydroxy 3 halopropyl type of the general formula:

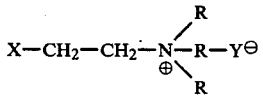

or salts of epoxy propyl ammonium (or glycidyl ammonium) components having the general formula:

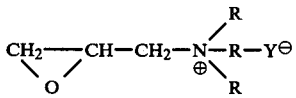

wherein X is a halogen radical, Y is an anionic group such as chloride, bromide, sulfate or sulfonate, and the R's are methyl, ethyl, butyl or benzyl groups or alcohols thereof.

A particularly preferred dye scavenging material is glycidyltrimethylammonium chloride. Glycidyltrimethylammonium chloride is commercially available under the name Glytac from Societe Protex, Levellois, France.

The dye scavenging material may be applied to a desired substrate by any suitable means or method. Typically, a dilute aqueous solution of the dye scavenging material will be prepared, and the desired substrate material passed through a bath thereof to impregnate fully the substrate material. The dye scavenging material will preferably be present in the solution in a concentration of about 4–10% by weight. In impregnating the substrate, the amount of solution applied to the substrate is preferably about equal to the weight of the substrate, i.e. about one part by weight. The aqueous solution may contain other ingredients such as base, like sodium hydroxide or sodium carbonate, although any suitable base should work. The solution is made "slightly alkaline" which herein means having the alkalinity provided by sodium hydroxide present in a concentration of about 0.5–40 grams per liter, or the basic equivalent thereof. A preferred alkalinity is provided by using sodium hydroxide in a concentration of about 10 grams per liter. One or more surface active agents may be added to enhance wetting of the substrate material by the dye scavenging material solution. Impregnation of substrate materials in such aqueous solutions of dye scavenging material may be conducted at any suitable temperature, but lower temperatures are preferred and impregnation is typically conducted at about room temperature.

The following examples further specifically illustrate the present invention wherein the novel dye scavenging members are made and used. The parts and percentages are by weight unless otherwise indicated. These examples are intended to illustrate various preferred embodiments of the novel dye scavenging system.

EXAMPLE I

A dye scavenger solution is prepared by mixing about 40 grams of Glytac (glycidyltrimethylammonium chloride commercially available from Societe Protex, Levellois, France) with about 10 grams of sodium hydroxide, about 10 milliliters of Protowet TJ (a surface active agent available from the Proctor Chemical Company, Salisbury, North Carolina), and about one liter of water. After thorough mixing of that solution, washcloth size pieces of white, towel-like loop pile terry cotton fabric is immersed in the solution, removed from the solution and excess solution extracted by passing the cloths through rubber wringer rolls. The cloths are then stored wet for about 12 hours. The cloths are then washed by conventional means to remove any excess solution, and then dried.

EXAMPLE II

The cloths made according to Example I are used by placing one of them in a load of laundry in conventional laundry equipment such as an automatic home laundry machine. Common laundry detergents may be used as usual, and bleaches and other laundry additives may also be used. Upon removal of the laundry after a normal machine cycle, it is observed that no "fading" has taken place from darker colored items onto lighter items, and light or white items retain their original brightness. Any dyes or colorants which do dissociate from their original item are scavenged by the dye scavenger member or cloth of the present invention which appears somewhat discolored when removed at the end of the normal wash cycle.

EXAMPLE III

The scavenger cloth used in Example II above is repeatedly reused as described in Example II. Such cloths have been successfully reused as many as about 5 to about 50 times before any visible undesirable discoloration of other items in the laundry load took place depending upon the particular laundry loads. The inventive scavenger cloth may be reused in its wet condition.

EXAMPLE IV

A dye scavenger solution is prepared as in Example I, and pieces of non-woven cellulosic fabric, available under the name "Novonette" from The Kendall Company, Walpole, Mass., are treated with the solution as described in Example I.

EXAMPLE V

The dye scavenger member-cloths made according to Example IV are used in the same ways described in Examples II and III, above, with the same desirable results. These non-woven substrate scavenger members have been successfully reused about 5 to about 15 times before any visible undesirable discoloration of other items in the laundry load took place, or the non-woven substrate began to lose its integrity.

Although specific components and proportions have been stated in the above description of the preferred embodiments of the novel dye scavenging system wherein dye scavenger material containing substrates are used, other suitable materials and minor variations in the various steps in the system as listed herein, may be used. In addition, other materials and steps may be added to those used herein, and variations may be made in the system to synergize, enhance or otherwise modify the properties of or increase the uses for the invention.

It will be understood that various other changes of the details, materials, steps, arrangements of parts and uses which have been herein described and illustrated in order to explain the nature of the invention will occur to and may be made by those skilled in the art, upon a reading of this disclosure, and such changes are intended to be included within the principle and scope of this invention.

What is claimed is:

1. A method of controlling undesirable random dye or colorant in a liquid bath containing sources of undesirable random dye or colorant and textile material of color other than the color of said undesirable dye or colorant, comprising placing in said bath a dye scavenger member comprising a cellulosic substrate material bearing a dye scavenger material, said dye scavenger material comprising a compound from the group consisting of:

a N-trisubstituted ammonium-2-hydroxy-3-halopropyl compound having the general formula

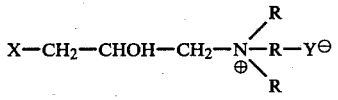

or a salt of epoxy propyl ammonium having the general formula

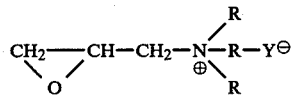

wherein X is a halogen radical, Y is chloride, bromide, sulfate or sulfonate, and the R's are methyl, ethyl, butyl or benzyl groups or an hydroxyl substituted derivative thereof and then using said liquid bath for its intended purpose, wherein said undesirable random dye or colorant becomes associated with said dye scavenger member.

2. The method of claim 1, wherein said substrate is a cellulosic material.

3. The method of claim 2 wherein said dye scavenger material is glycidyltrimethylammonium chloride.

4. The method of claim 3 wherein said substrate is a non-woven textile material.

5. A method of preventing discoloration of textile materials in a liquid laundry bath, comprising: providing a laundry bath with textile materials of different colors therein, placing in said bath a dye scavenger member comprising a cellulosic substrate material bearing a dye scavenger material, said dye scavenger material comprising a compound from the group consisting of:

a N-trisubstituted ammonium-2-hydroxy-3-halopropyl compound having the general formula

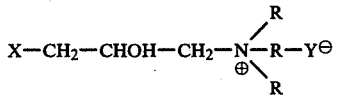

or a salt of epoxy propyl ammonium having the general formula

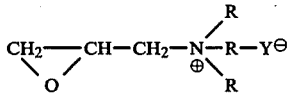

wherein X is a halogen radical, Y is chloride, bromide, sulfate or sulfonate, and the R's are methyl, ethyl, butyl or benzyl groups or an hydroxyl substituted derivative thereof, leaving said dye scavenger member in said bath throughout an entire laundering procedure, whereby any random dyes or colorants which dissociate from said differently colored textile materials become associated with said dye scavenger member and do not discolor a textile material of a different color from said random dyes or colorants.

6. The method of claim 5, wherein the steps of claim 5 are repeated a plurality of times using the same dye scavenger member.

7. The method of claim 5 wherein said substrate is a cellulosic material.

8. The method of claim 5 wherein said substrate is a cotton fabric.

9. The method of claim 7 wherein said substrate is non-woven.

10. The method of claim 5 wherein said dye scavenger material is glycidyltrimethylammonium chloride.

11. A method of preventing discoloration, and promoting the color brightness of textile materials in an aqueous laundry bath, comprising:

providing an aqueous laundry bath with textile materials of different colors therein, at least one of said textile materials having a dye or colorant associated therewith, including in said bath a dye scavenger member consisting of a cellulosic substrate and a dye scavenging material, namely glycidyltrimethylammonium chloride, and leaving said dye scavenger member in said bath throughout an entire laundering procedure at the conclusion of which the bath and textile materials are separated, whereby any random dye or colorant which dissociates from any of said differently colored textile materials becomes associated with said dye scavenger member and does not discolor in said bath a textile material of a different color from said random dyes and colorants.

12. The method of claim 11, wherein the steps of claim 11 are repeated a plurality of times using the same dye scavenger member.

13. The method of claim 12 wherein said substrate is a non-woven textile member.

* * * * *